US006874765B2

(12) United States Patent
Deeley

(10) Patent No.: US 6,874,765 B2
(45) Date of Patent: Apr. 5, 2005

(54) COLD ROLLED POST FOR SECURITY FENCE

(75) Inventor: Geoffrey Thomas Deeley, West Midlands (GB)

(73) Assignee: Hadley Industries PLC (GB)

( * ) Notice: Subject to any disclaimer, the term of this patent is extended or adjusted under 35 U.S.C. 154(b) by 0 days.

(21) Appl. No.: 10/404,381

(22) Filed: Apr. 1, 2003

(65) Prior Publication Data

US 2003/0197163 A1 Oct. 23, 2003

(30) Foreign Application Priority Data

Apr. 17, 2002 (GB) ..... 0208823

(51) Int. Cl.[7] ..... E04H 17/14
(52) U.S. Cl. ..... 256/21; 256/59
(58) Field of Search ..... 256/19, 21, 22, 256/59, 1

(56) References Cited

U.S. PATENT DOCUMENTS

| | | | | |
|---|---|---|---|---|
| 991,603 A | | 5/1911 | Brooks | |
| 2,520,313 A | * | 8/1950 | Harris | 256/22 |
| 3,342,007 A | | 9/1967 | Merson | |
| 5,163,225 A | | 11/1992 | Goleby | |
| 5,275,382 A | | 1/1994 | Charbaut et al. | |
| 5,860,636 A | | 1/1999 | Duncan et al. | |
| 2003/0197162 A1 | * | 10/2003 | Albritton | 256/13.1 |

FOREIGN PATENT DOCUMENTS

| | | |
|---|---|---|
| DE | 1023210 | 1/1958 |
| DE | 4109052 | 9/1992 |
| EP | 0 935 038 A1 | 8/1999 |
| GB | 1584760 | 2/1981 |
| GB | 2139666 A | 11/1984 |
| GB | 2291081 A | 1/1996 |
| GB | 2 312 005 A | 10/1997 |
| GB | 2350846 A | 12/2000 |
| WO | WO 97/03266 A1 | 1/1997 |
| WO | WO 00/04257 A1 | 1/2000 |
| WO | WO 02/070838 A1 | 9/2002 |
| WO | WO 2003/089728 A3 | 10/2003 |

* cited by examiner

*Primary Examiner*—John Cottingham
(74) *Attorney, Agent, or Firm*—Caesar, Rivise, Bernstein, Cohen & Pokotilow, Ltd.

(57) ABSTRACT

A post for a security fence and comprises a thin sheet of steel which has been cold-formed to be of generally I section and is then galvanised.

13 Claims, 2 Drawing Sheets

COLD ROLLED POST FOR SECURITY FENCE

The invention relates to security fencing and in particular of the type known as palisade fencing. A palisade fence consists of two posts between which there is at least one generally horizontal rail. Pales, i.e. vertical members, are connected to the rails parallel to the posts. Usually the top of the pales projects above the level of the rail or the upper rail. The pales may be made of metal and are available in a wide variety of shapes. The end posts can be of concrete or of metal. Where the post is made of metal it is typically very thick and made of, for example, hot-rolled steel section. The post, whether concrete or hot rolled metal, is heavy and it is a job for the operators to construct a fence using such posts.

It is an object of this invention to make a security fence, typically a palisade fence, having posts which are relatively light weight but are so shaped that they will have enough mechanical strength to be able to support the weight of the rails and the pales and withstand applied loads such as an impacting force or a load due to wind. The invention is based on the realisation that a post may be made of cold-rolled metal section provided that the section is of a suitable shape. One important feature to this shape is the presence of side walls which are hollow, and which will permit the application of a corrosion resistant coating to the section after it has been formed.

In one aspect the invention provides a security fence comprising two posts and at least one rail extending between the posts and a plurality of pales connected to the rail, wherein at least one post comprises a cold rolled metal section of generally I-form, having a main web and two side flanges which are shaped to define a cavity through which gases can pass, the upper end of the post being shaped to form a security head.

Preferably the section is from about 2 mm to about 4 mm thick, preferably about 2.5 mm thick. The post may be about 100 to about 120 mm wide and the side walls about 30 to about 50 mm wide.

It is a much preferred feature of the invention that the cold rolled post has been galvanised. The benefit of having a cavity in the side walls, i.e. that the side walls are hollow is that when the post is galvanised, gases can easily escape.

The cold rolled section post has a security or anti-intruder head. This may be of known form, e.g. of single point or multiple point shape and which may be of spear or flat form.

The lower end of the post may also take a variety of forms. For example, the end of the cold rolled section post, which, in use, is to contact a substrate may be connected to a base plate or may have holes for improved keying into concrete.

The rail or rails may be connected to the post in any known way. In one embodiment the main web of the cold rolled section post has at least one hole for reception of one end of the rail or a fishplate.

The pales may be of known form. Preferably the pales are formed of cold rolled metal section. It is a preferred feature of the invention that the pale has the shape defined in my copending application Ser. No. 10/407,567 lodged on the same day as this application and entitled SECURITY FENCE WITH SECURED BOLTS, the entire disclosure of which is incorporated herein. In such a case each pale has at least one hole to receive a fastener having a head and a shank, with the shank extending through the hole and the underside of the head being in contact with the surface of the pale, integral shoulder means being located adjacent the or each hole, the shoulder means being shaped to deny access to the underside of the head of a so-received fastener, whereby the fastener cannot be prised away from the pale.

Another preferred pale comprises a cold-formed metal section shaped to have a longitudinal web and a longitudinal side wing extending from each side thereof, the hole and shoulder means being present in and on the web respectively. Preferably the shoulder means comprises two shoulders on diametrically opposite sides of the or each hole. Preferably each shoulder comprises a ramp portion rooted remote from the or each hole and inclined upwardly theretowards and terminating in a face portion inclined downwardly towards the or each hole.

Typically the pales extend a vertical distance above the horizontal rail or the upper horizontal rail.

The fence may also include panels joined to the rails; these may be solid or perforate.

The rail may be of any known form. Preferably however the rail is according to my copending application Ser. No. 10/407,566 lodged on the same day as this application and entitled SECURITY FENCE WITH IMPROVED RAIL, the entire disclosure of which is incorporated herein. In such a case the rail comprises a main web and at least one side wall, the pales abutting one face of the web of the rail, the side wall extending above the web away from the rail on the side of the web remote from the pales at an angle selected so that the gap portions of the rail between pales cannot be used by an intruder as a step. Preferably, spikes are struck up from the upper sidewall in the gaps.

In another aspect the invention provides a method of making a galvanised post made of cold rolled metal section, the method comprising folding flat sheet to generally I-form to have a main web and side flanges, shaping one end to the shape of a security head by folding the adjacent flange inwardly while leaving a small gap, dipping the section in a galvanising composition whereby all the surfaces of the section are galvanised and any released fumes can escape through the gap.

In order that the invention may be well understood it will now be described by way of example only in which.

Figure 1:
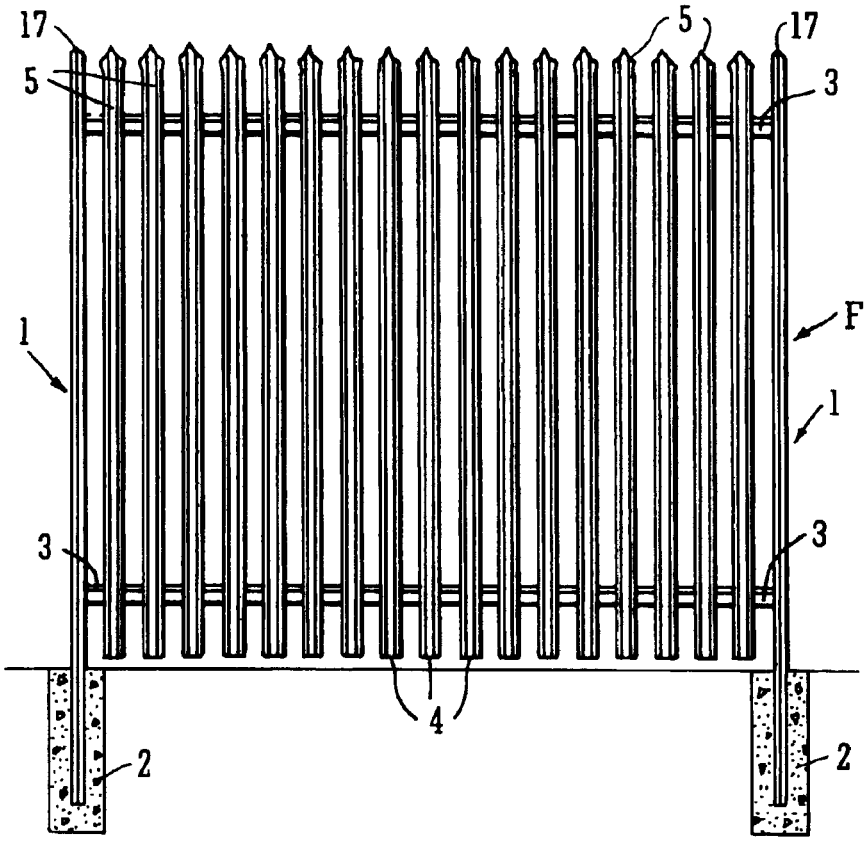
FIG. 1 is a front elevation of one palisade fence of the invention.
Figure 2:
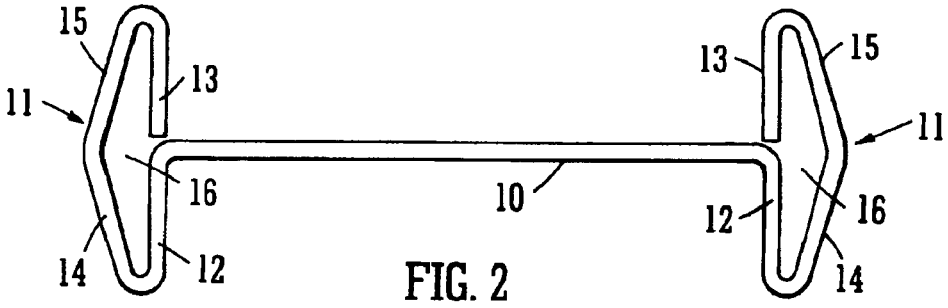
FIG. 2 is a transverse section of the post taken on line II—II drawn to an enlarged scale.

The palisade fence F comprises two upright posts 1 the lower end of which is embedded in a concrete bed 2. Two horizontal rails 3 extend between the posts 1, and joined thereto by fishplates or the like, not shown. Pales 4 are connected by bolts or rivets, not shown, to the horizontal rails 3. The heads of the pales are formed into anti-intruder heads 5. The end posts are made of galvanised steel section and, in the main, have the cross-sectional shape shown in FIG. 2. The section is of general I shape and comprises a main web 10 and two integral side flanges or walls 11. The side walls 11 are folded side portions of the main web and are of general arrowhead or radius shape having two generally inner straight walls 12, 13 and two outer angled portions 14, 15 and defining a cavity 16. The section is 2.5 mm thick steel and measures 114 mm in width; the side walls project 12 mm beyond the main web 10 and have a maximum width of 44 mm. The steel has a density of 7850 $kg/m^3$. At its upper end the side walls are folded in to a point, to form a security or anti intruder head 17.

Although the post 1 is formed of thin section sheet it has relatively high mechanical strength as a result of its shape.

Thus, despite the posts having to support the weight of the fence rails 3 and pales 4, each will undergo little deflection, e.g. under a strong wind force or an impact. By virtue of its size and shape and mechanical properties, and despite being lightweight a post of this invention can equal the properties of a hot rolled steel joist.

Figure 3A:
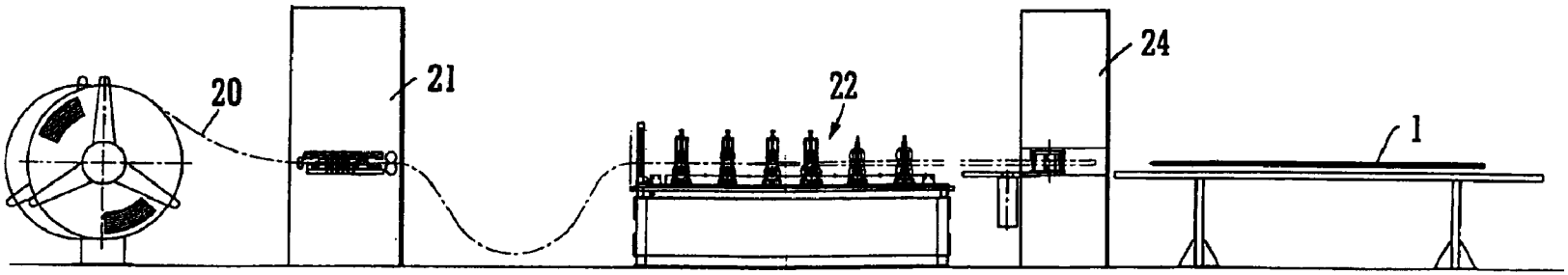
FIG. 3 is a flow diagram showing one method of forming the posts from sheet metal.
Figure 3B:
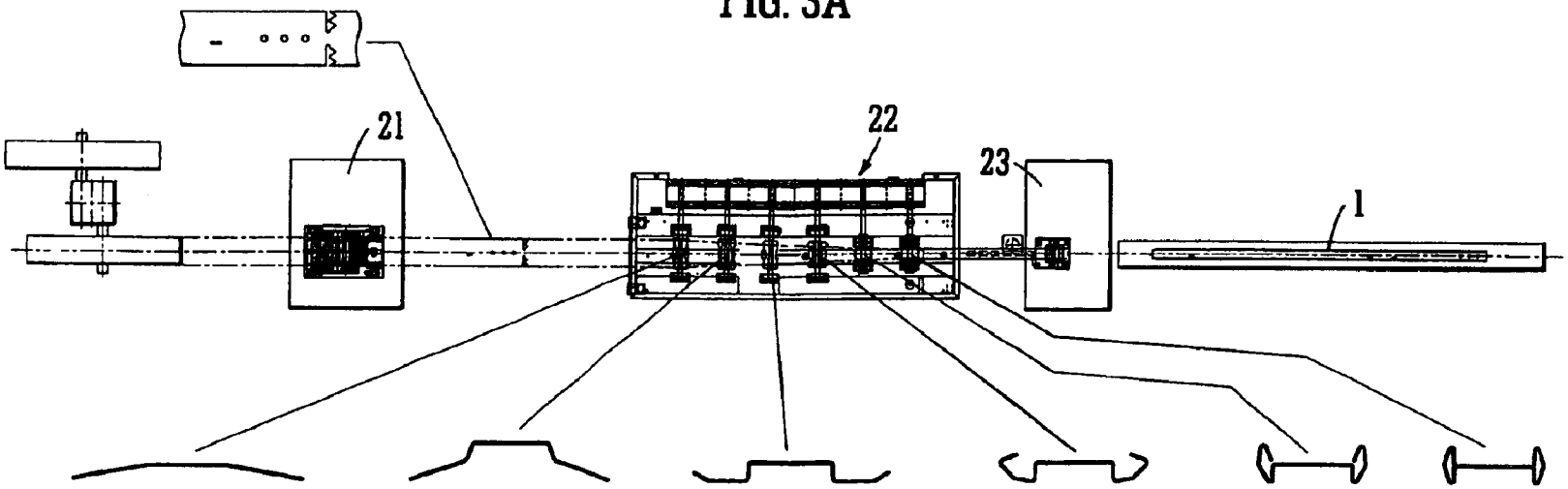

Each post 1 is made of galvanised steel. The method of manufacture is illustrated in the flow diagram of FIG. 3. Ungalvanised steel sheet 20 is drawn from a drum and passed through a prepiercing press 21 to produce bolt receiving holes and form the end 17; the strip is then passed through a series of rollers 22 to form the flat sheet into the profile 23. The finished strip is then passed through a cut off press 24 to cut the profile to length and close the gap on the head detail. The lower part of FIG. 3 shows sections at the different stages, drawn to an enlarged scale. The section is then hot dipped in a galvanised bath, not shown, and because the side walls are hollow, i.e. have cavity 16, gases can escape and yet all the surface area of the shape is covered with a galvanised coating. As a result the post is totally corrosion proof.

Our evaluations have established that fences having posts of the invention can withstand impact forces, and resists attempts by thieves and terrorists.

Figure 4:
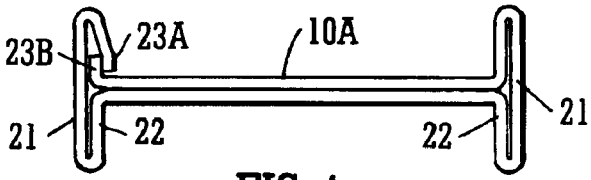
FIG. 4 is an end view of another post.

In the embodiment of FIG. 4, the side walls having generally parallel portions 21 and 22. These are made by folding the sheet on itself to have a double thickness web 10A and abutting the free ends 23A, 23B at one of the side flanges. The post has the shaped head 17. Such a post may be made of pregalvanised steel sheet.

The invention is not limited to the embodiment shown. The free end of the side wall sheet, i.e. wall 13 may be welded to the main web 10. More than one hole may be present in the main web, to receive rails. Holes may be present at the lower end of the post for improved keying with concrete or a base plate may be present. The head of the post need not be pointed. The pales need not project above the upper rails.

The surface of the section may be powder coated instead of being galvanised or it left untreated. The post may be formed of pre-galvanised steel or other material.

What is claimed is:

1. A security fence comprising two posts, and at least one rail extending between the posts and a plurality of pales connected to the rail, at least one of the posts being of generally I-form, comprising a main web having a longitudinal axis and two integral sides which extend at generally right angles to said longitudinal axis of said main web; each of said sides including a longitudinally extending substantially enclosed hollow; and cavity through which gases can pass, the post having an upper end shaped to form a security head.

2. A security fence according to claim 1, wherein the at least one post is galvanised or powder coated.

3. A security fence according to claim 1, wherein the at least one post is formed of section having a thickness of about 2 nm to about 4 mm.

4. A security fence according to claim 1, wherein the security head has a shape selected from the group of a single point or multiple point shape and spear or flat form.

5. A security fence according to claim 1, wherein the main web of the post has at least one hole for connection to the or each at least one rail.

6. A security fence according to claim 1, wherein the at least one post has total width of about 100 mm to about 120 mm and the side flanges are about 30 to about 50 mm wide in total.

7. A security fence according to claim 1, wherein the pales are formed of cold rolled metal section.

8. A security fence according to claim 1, wherein the pales are each secured by a releasable fastener to one side of the at least one rail, the pales being spaced apart along the at least one rail with gaps in between, the at least one rail comprising a main web and at least one side wall, the pales abutting one face of the web of the at least one rail, the side wall extending above the web away from the at least one rail on the side of the web remote from the pales at an angle selected so that the gap portions of the rail between pales cannot be used by an intruder as a step.

9. A security fence according to claim 8, wherein the sidewall includes an upper portion and spikes are struck up from the upper portion of the sidewall in the gap portions.

10. A security fence according to claim 1, wherein each pale has at least one hole to receive a fastener having a head including an underside and a shank, with the shank extending through the hole and the underside of the head being in contact with a surface of the pale, integral shoulder means being located adjacent the or each hole, said shoulder means being shaped to deny access to the underside of the head of a so-received fastener, whereby the fastener cannot be pried away from the pale.

11. A fence according to claim 10, wherein each shoulder means comprises a ramp portion rooted remote from the or each hole and inclined upwardly theretowards and terminating in a face portion inclined downwardly towards the or each hole.

12. A security fence according to claim 1, wherein each side comprises a side flange which has been folded to have a first straight portion, an upwardly inclined portion, a downwardly inclined portion and a straight end portion, the first portions and the end portion being aligned whereby the cavity is of general arrowhead shape.

13. A security fence according to claim 1, wherein the main web and the sides are of double wall thickness, and has been made by folding cold rolled sheet on itself so that the free ends of the sheet are present in one of the sides and provide a cavity through which gas can pass.

* * * * *